US005193507A

United States Patent [19]

Rossignol

[11] Patent Number: 5,193,507

[45] Date of Patent: Mar. 16, 1993

[54] FUEL INJECTION DEVICE FOR FUEL-INJECTED INTERNAL COMBUSTION ENGINES

[75] Inventor: Francois Rossignol, Mornant, France

[73] Assignee: Robert Bosch GmbH, Stuttgart, Fed. Rep. of Germany

[21] Appl. No.: 776,010

[22] PCT Filed: Mar. 1, 1991

[86] PCT No.: PCT/DE91/00184

§ 371 Date: Nov. 22, 1991

§ 102(e) Date: Nov. 22, 1991

[87] PCT Pub. No.: WO91/15675

PCT Pub. Date: Oct. 17, 1991

[30] Foreign Application Priority Data

Mar. 31, 1990 [DE] Fed. Rep. of Germany ..... 4010450

[51] Int. Cl.[5] ..... F02M 37/04; F02M 57/02

[52] U.S. Cl. ..... 123/446; 123/500

[58] Field of Search ..... 123/500, 501, 446, 447, 123/506, 179.17

[56] References Cited

U.S. PATENT DOCUMENTS

| | | | |
|---|---|---|---|
| 4,069,800 | 1/1978 | Kanda et al. | 123/447 |
| 4,219,154 | 8/1980 | Luscomb | 123/472 |
| 4,310,291 | 1/1982 | Green et al. | 123/179.17 |
| 4,425,894 | 1/1984 | Kato et al. | 123/446 |
| 4,653,455 | 3/1987 | Eblen et al. | 123/506 |
| 4,705,006 | 11/1987 | Bastenhof | 123/501 |
| 4,764,092 | 8/1988 | Thornthwaite | 123/179.17 |
| 4,831,988 | 5/1989 | Hoefken et al. | 123/501 |
| 4,976,236 | 12/1990 | Brunel | 123/447 |
| 4,976,244 | 12/1990 | Eckert | 123/501 |
| 5,076,236 | 12/1991 | Yu et al. | 123/500 |

*Primary Examiner*—E. Rollins Cross
*Assistant Examiner*—Thomas Moulis
*Attorney, Agent, or Firm*—Edwin E. Greigg; Ronald E. Greigg

[57] ABSTRACT

A fuel injection device for fuel-injected internal combustion engines, in particular to a unit fuel injector, in which the control of the onset and end of supply is effected by means of a magnet valve incorporated between a low-pressure circuit and a work chamber of a pump piston; a scavenging bore, connectable to the work chamber, of a scavenging line that communicates with a low-pressure chamber or the tank is provided. A delivery line for delivering the fuel from the magnet valve to the work chamber of the pump piston discharges directly into the pump work chamber and communicates with it in a permanently open fashion. The arrangement is selected such that the mouth of the scavenging bore is located in a region of the guide bore of the pump piston which is overridden by the pump piston in all the positions of the pump piston, and this mouth is connectable at least indirectly to the delivery line and the work chamber of the pump piston, via a recess of the piston, in the region of the top dead center position of the piston.

11 Claims, 6 Drawing Sheets

FUEL INJECTION DEVICE FOR FUEL-INJECTED INTERNAL COMBUSTION ENGINES

RELATED PATENT APPLICATION

This invention relates to PCT/DE 91/00179 filed Mar. 1, 1991.

The invention relates to a fuel injection device for fuel-injected internal combustion engines, in particular to a unit fuel injector, in which the control of the onset and end of supply is effected by means of a magnet valve incorporated between a low-pressure circuit and a work chamber of a pump piston; a scavenging bore, connectable to the work chamber, of a scavenging line that communicates with a low-pressure chamber or the tank is provided, and a delivery line for delivering the fuel from the magnet valve to the work chamber of the pump piston discharges directly into the pump work chamber and communicates with it in a permanently open fashion.

Particularly when the injection device is put into operation or if there is some malfunction in fuel delivery, there are air inclusions or gas bubbles in the work chamber of the piston and in the lines; when relief suddenly occurs at the end of injection, these inclusions and bubbles implode and cause cavitation and erosion of the pistons and conduits; they also impair the stability of the injection. Scavenging is intended to flush away these air inclusions or gas bubbles from the critical regions, to avoid destruction of the surfaces. Such embodiments of an injection device are known, for instance from European Patent Document A 0 207 652. There, however, the work chamber of the piston is located in a shunt around the scavenging flow, impairing the scavenging effectiveness. This known embodiment also requires a large number of conduits and control grooves, which creates idle spaces that have a harmful effect, particularly at the high injection pressures used today, of 1200 to 1600 bar, for instance. Satisfactory scavenging is therefore not attained in this known embodiment.

The object of the invention is to improve the scavenging.

The invention therefore resides substantially in that the mouth of the scavenging bore is located in a region of the guide bore of the pump piston which is overridden by the pump piston in all the positions of the pump piston, and that this mouth is connectable at least indirectly to the delivery line and the work chambers of the pump piston, via a recess of the piston, in the region of the top dead center position of the piston. Since the mouth of this scavenging bore is located in the region of the piston guide bore overridden by the piston, it is closed off until such time as the recess overrides this guide bore. Since this recess overrides the scavenging bore in the top dead center position of the piston, the scavenging bore is uncovered in the top dead center position, and the scavenging ensues. Since the delivery line or its connecting bore communicates in a permanently open fashion with the pump work chamber, the scavenging flow now takes place via the pump work chamber as soon as the recess opens the scavenging bore, so that the pump work chamber is scavenged effectively. It is advantageous if the cam has a circular-cylindrical zone in the region of its highest lobe, and the center of the radius of curvature of this zone coincides with the center of the camshaft, so that the scavenging bore is kept open for the duration of scavenging.

According to features set forth herein, the arrangement is advantageously selected such that a delivery bore forming part of the delivery line from the magnet valve to the work chamber discharges into the guide bore in a region of the guide bore of the piston that is overridden by the recess in the region of the top dead center position of the piston, and a connecting bore communicating openly with the work chamber branches off from the guide bore near the mouth thereof into the guide bore of the piston, the recess of the piston being preferably embodied as an annular groove.

According to additional features, the recess or annular groove of the pump piston may also communicate openly with the work chamber thereof via a relief line provided in the piston. Accordingly, the relief line in the pump piston may have both a longitudinal bore, which communicates openly with its work chamber of the pump piston, and a transverse bore that intersects the longitudinal bore and discharges into the recess or annular groove. By means of this kind of relief bore or longitudinal and transverse bore in the piston, an additional path for the scavenging flow can be created, which reinforces the scavenging flow. However, this relief line or longitudinal and transverse bore provided in the piston may also form the sole scavenging flow path. Also, a throttle cross section may be incorporated into one of the bores of the relief line in the piston.

The embodiment may also be selected such that the delivery line discharges only into the work chamber of the pump piston, and an edge toward the work chamber of the recess of the pump piston cooperates with a control edge of the guide bore of the pump piston; in the region of top dead center of the pump piston, the recess connects the work chamber of the pump piston with the scavenging bore, optionally via an annular groove into which the scavenging bore discharges; preferably, the recess is embodied by at least one transverse slit in the jacket of the pump piston.

In the drawing, the invention is schematically explained in terms of the exemplary embodiments.

Figure 5:
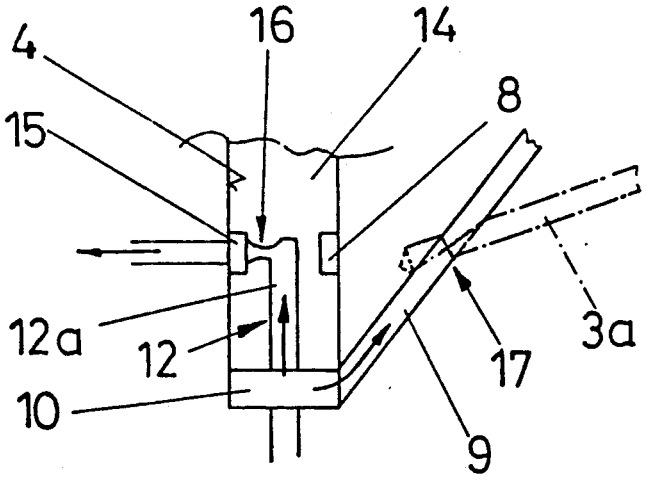

FIG. 5, in a detail, shows a modified embodiment similar to that of FIG. 2.

Figure 6:
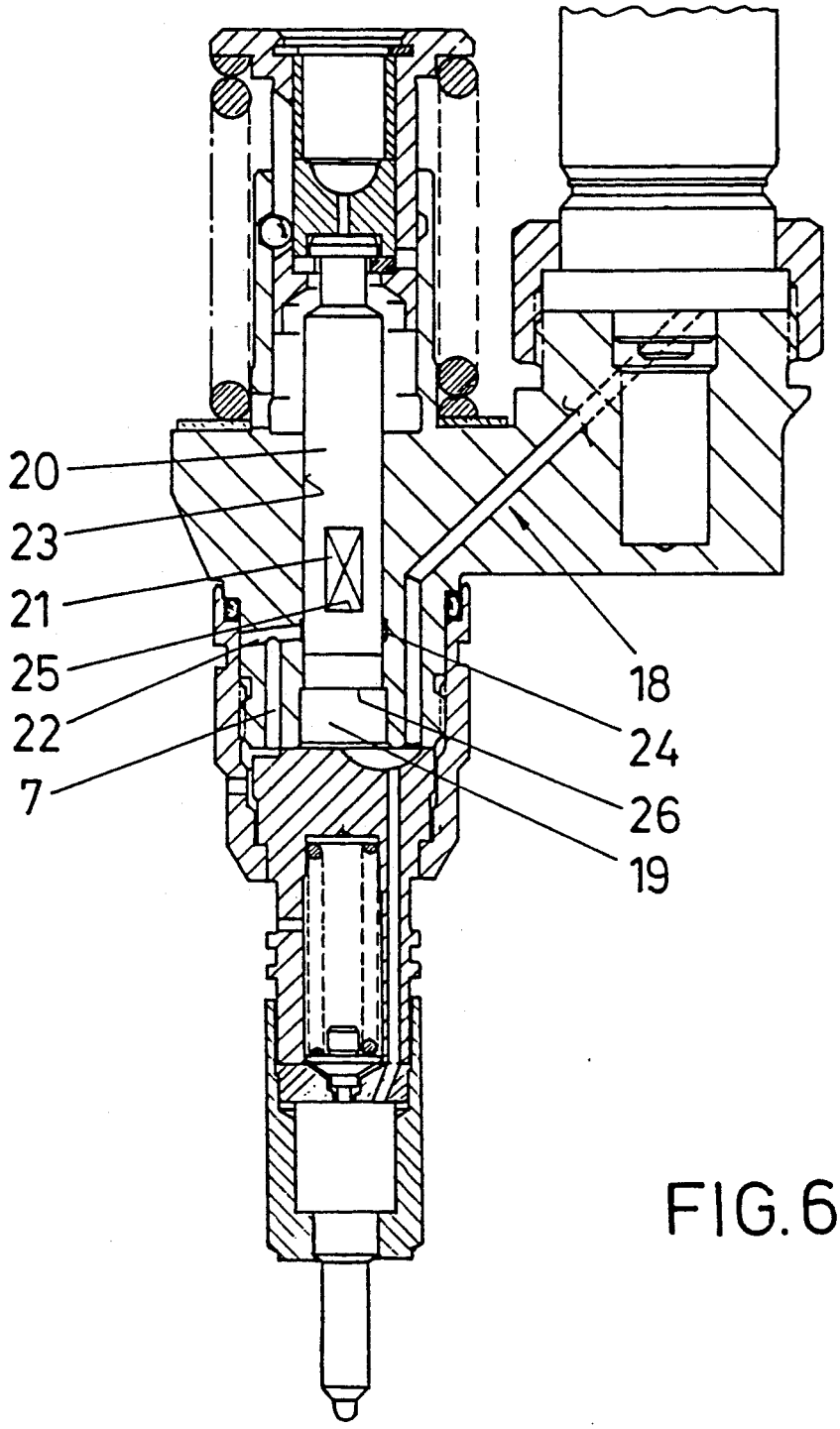

FIG. 6 shows a modified embodiment of the invention in axial section, with the piston shown in the bottom dead center position.

Figure 7:
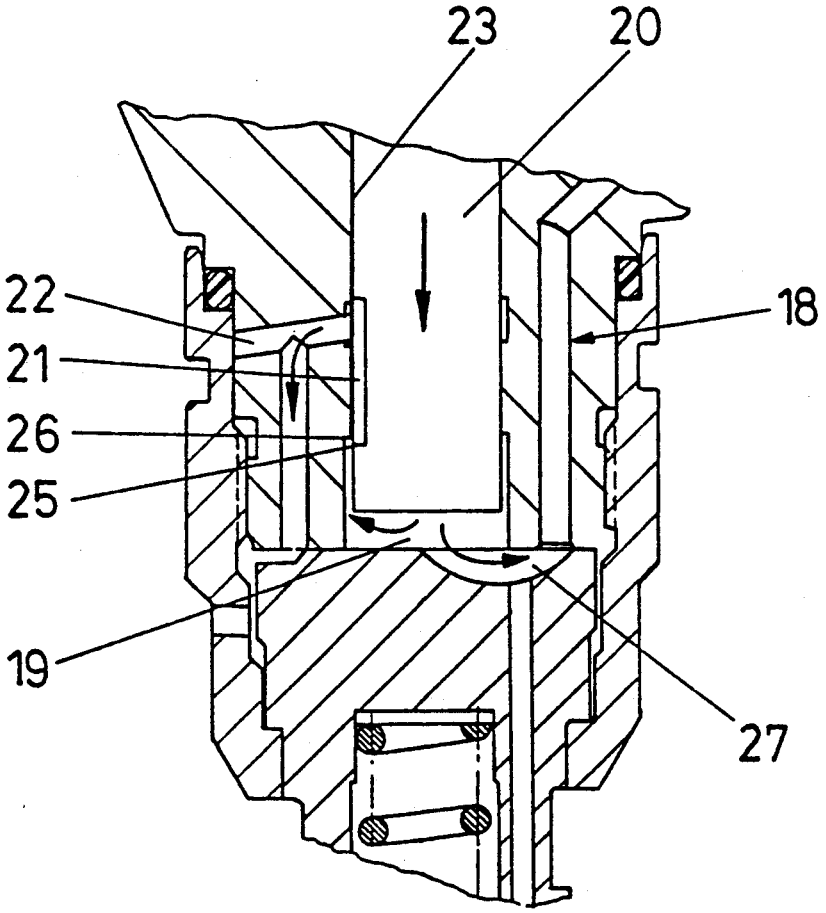

FIG. 7 shows a detail corresponding to FIG. 6, showing the piston in the top dead center position.

Figure 1:
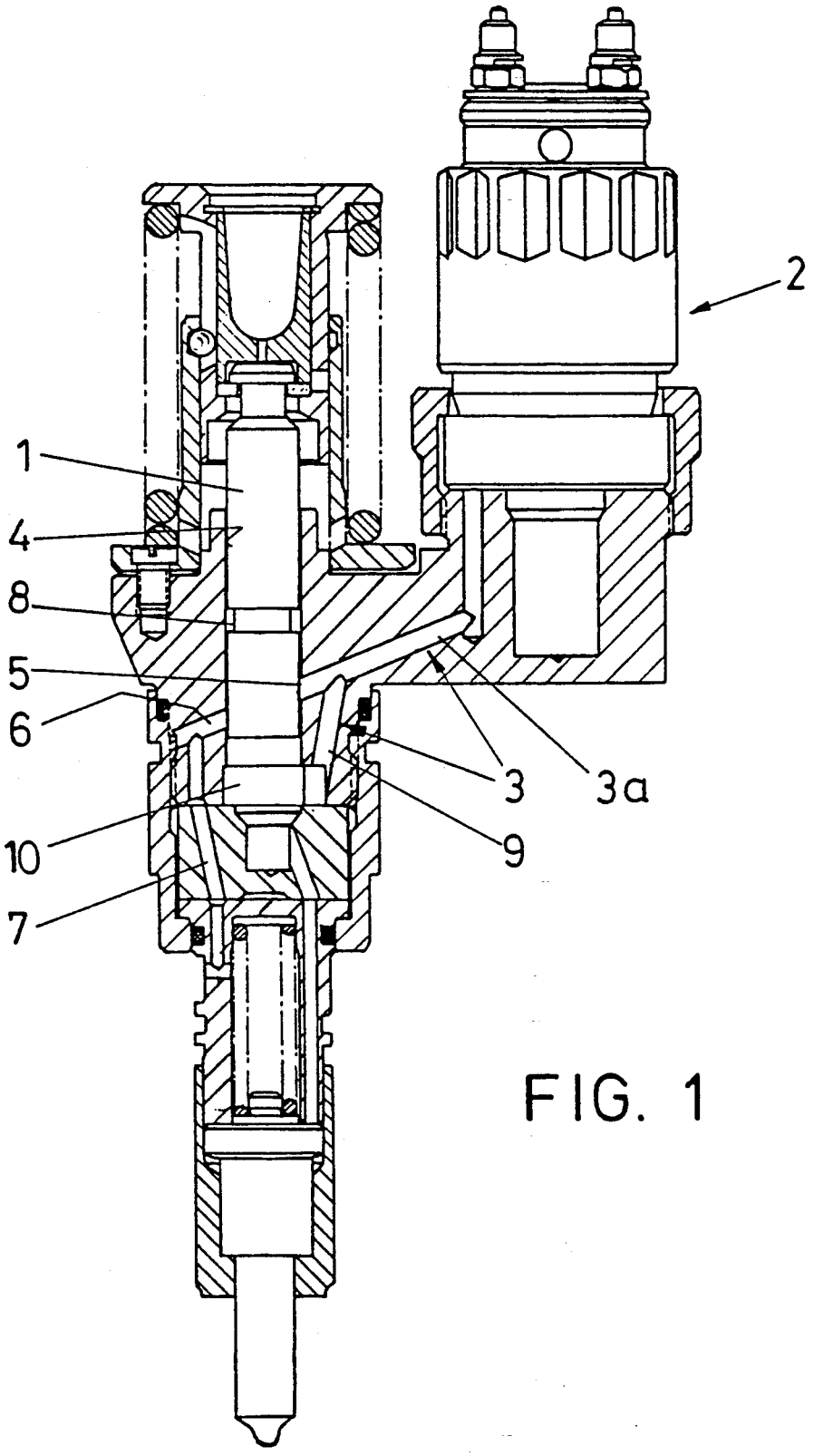
FIG. 1 shows one embodiment of the invention, in axial section.

In the arrangement of FIG. 1, reference numeral 1 stands for the pump piston. In this view, the pump piston 1 is in the bottom dead center position. Beginning at a magnet valve 2, a delivery bore 3*a* of a delivery line 3 for the fuel discharges into the guide bore 4 of the piston 1. The mouth is marked 5. Reference numeral 6 is a scavenging bore, to which a scavenging line 7 that leads to the fuel tank is connected. Reference numeral 8 is an annular groove in the piston serving as a recess of the piston 1. A connecting bore 9, which communicates with the pump work chamber 10 in a permanently open connection, branches off from the bore 3*a*, originating at the magnet valve 2, of the delivery line 3.

Figure 2A:
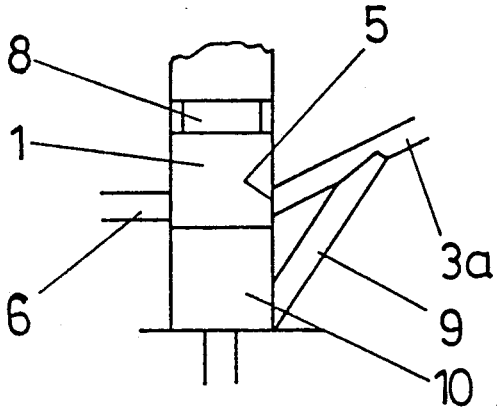
FIGS. 2A, 2B, 2C and 2D show various positions of the piston in the arrangement of FIG. 1.

In the view of FIG. 2A, the piston 1 is located in the bottom dead center position. The mouth 5 of the fuel delivery bore (3*a*) is closed off by the piston, and the fuel is aspirated via the connecting bore 9 and the delivery bore 3*a*.

Figure 2B:
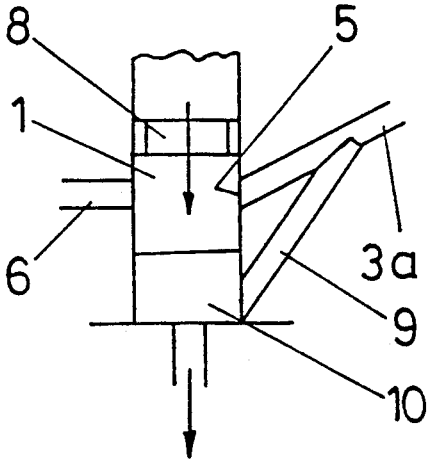

FIG. 2B shows the piston 1 in the position at the end of injection during its downward course, which is represented by arrows.

Figure 2C:
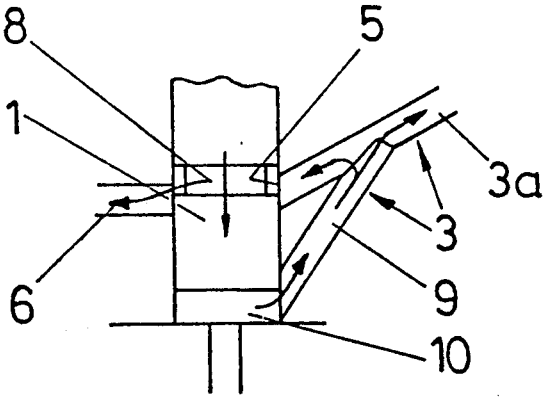

In FIG. 2C, the piston 1 is shown in its further downward course. The piston is approaching its top dead center position; the annular groove 8 of the piston 1 opens the mouth 5 of the fuel delivery bore 3*a*, and the fuel is pumped out of the pump work chamber 10 via the connecting bore 9 and the annular groove 8 into the scavenging bore 6, so that effective scavenging ensues. Since the connecting bore 9 discharges into the fuel delivery line 3 near the mouth 5 of the delivery bore 3*a*, the main scavenging flow, as indicated by arrows, is via the annular groove 8 to the scavenging bore 6. Some of the returning fuel is also diverted via the magnet valve 2, as indicated by an arrow.

Figure 2D:
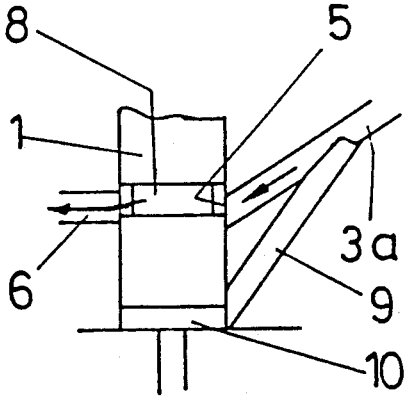

In FIG. 2D, the piston 1 is shown in its top dead center position. The annular groove 8 has uncovered the mouth 5 of the bore 3*a* that originates at the magnet valve, and scavenging now takes place via the magnet valve 2, the delivery line 3 and the annular groove 8 at fore-pump pressure, as indicated by arrows.

Figure 3:
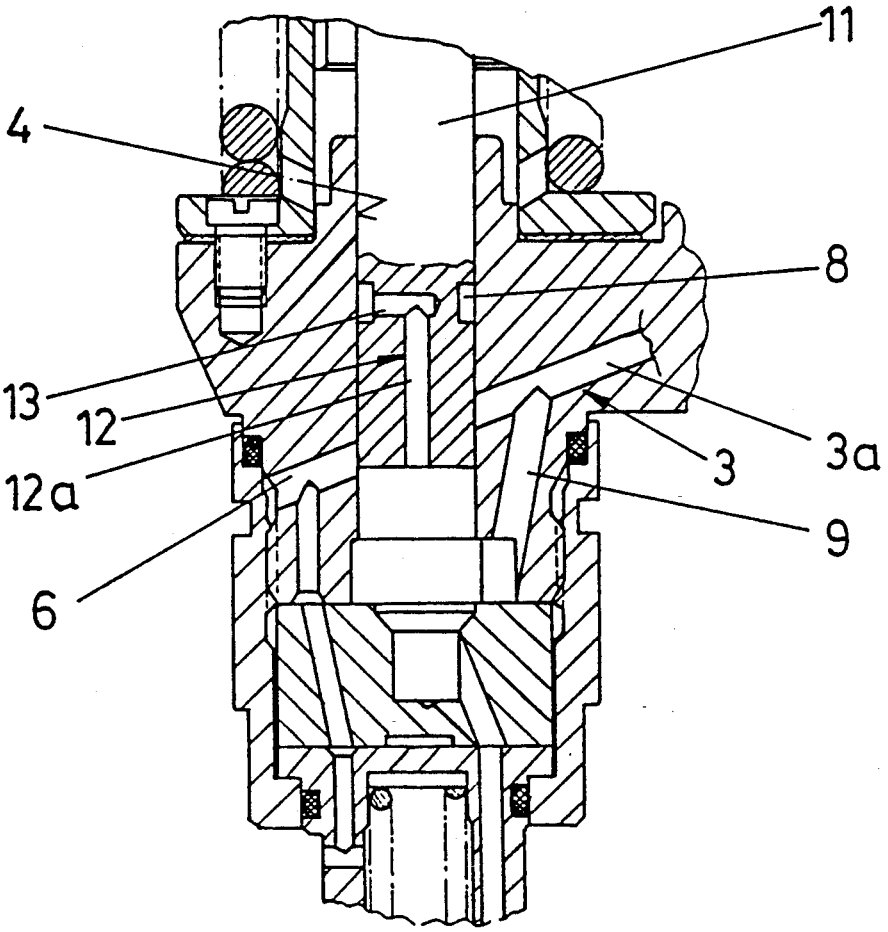
FIG. 3 shows a different embodiment in a fragmentary axial section.

In FIG. 3, a modified embodiment is shown. The embodiment of FIG. 3 differs from the embodiment of FIG. 1 in that the pump piston 11 has a relief line 12 with a longitudinal bore 12*a*, from which a transverse bore 13 branches off that in turn discharges into the annular groove 8. In this embodiment, the scavenging flow is carried not only via the bores 9 and 3*a* of the delivery line 3 to the annular groove 8 and from it to the scavenging bore 6, but also via the bores 12*a* and 13 of the relief line 12.

Figure 4:
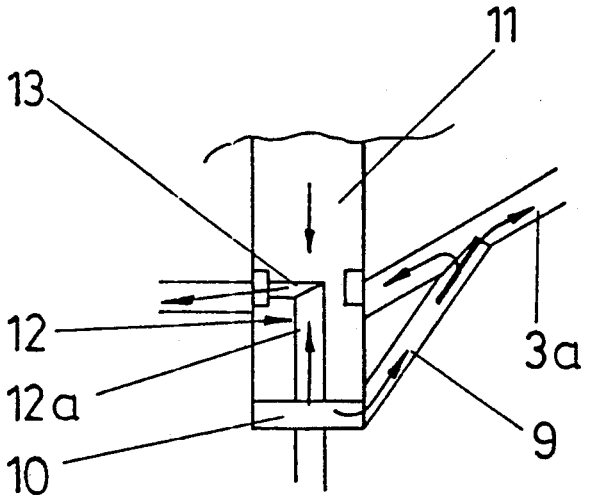
FIG. 4 shows the piston of FIG. 3 in the top dead center position.

In FIG. 4, the pump piston 11 is shown in the top dead center position, and the scavenging flow is indicated by arrows.

FIG. 5 shows a version in which the pump piston 14 again has a relief line 12A having the longitudinal bore 12*a* and a transverse bore 15, which discharges into the annular groove 8. In the transverse bore 15, a throttle cross section 16 is incorporated here. The delivery of fuel from the magnet valve to the work chamber 10 is effected directly through a delivery line 17. The bore 3*a* provided in the arrangement of FIG. 3, which there discharges into the guide bore 4 of the piston 11, is omitted here in FIG. 5, or else in a further variant it terminates upstream of the guide bore 4 (as indicated by dot-dash lines), specifically at the branching point of the portion of the delivery line 17 that now is embodied only as a short connecting bore 9 to the work chamber 10. Here, the scavenging flow is effected via the bores 12*a* and 15 and via the delivery line 17 and magnet valve.

FIGS. 6 and 7 show a modified version. From the magnet valve 2, a delivery line 18 leads directly into the work chamber 19 of the pump piston 20. The recess of the pump piston 20 is formed by at least one transverse slit 21 milled into the piston jacket. The scavenging bore 22 discharges into an annular groove 24 machined into the guide bore 23. In the region of the top dead center position of the piston 20, shown in FIG. 7, an edge 25 of the transverse slit 21 toward the work chamber overrides a control edge 26*a* of the guide bore 23. The mouth of the scavenging bore 22 is made to communicate with the work chamber 19 via the transverse slit 21, as soon as the edge 25 of the transverse slit 21 overrides the control edge 26*a* that is machined into the guide bore 23 and embodied by a widened portion 26 thereof, so that scavenging in the direction of the arrow takes place in the region of top dead center of the piston 20. A recess 27 is machined into the wall, opposite the end face of the piston 20, that defines the work chamber 19, so that at top dead center of the piston 20 scavenging can also take place in the direction of the arrow via the recess 27, the delivery and the magnet valve 2.

Since the scavenging bore 22 discharges into the annular groove 24, the piston 20 can be used in any arbitrary rotational position.

In FIG. 7, a transverse slit 21 is shown rotated compared with the arrangement of FIG. 6, for the sake of greater clarity.

The foregoing relates to a preferred exemplary embodiment of the invention, it being understood that other variants and embodiments thereof are possible within the spirit and scope of the invention, the latter being defined by the appended claims.

LIST OF REFERENCE NUMERALS

1 pump piston
2 magnet valve
3 delivery line
3*a* delivery bore
4 guide bore of the pump piston
5 mouth of the delivery bore
6 scavenging bore
7 scavenging line
8 annular groove
9 connecting bore
10 work chamber
11 pump piston
12, 12A relief line
12*a* longitudinal bore
13 transverse bore
14 pump piston
15 transverse bore
16 throttle cross section
17 delivery line
18 delivery line
19 work chamber
20 piston
21 transverse slit in piston jacket
22 scavenging bore
23 guide bore
24 annular groove
25 lower edge of the transverse slit
26 widened portion of the guide bore
26*a* control edge of the guide bore
27 recess

I claim:

1. A fuel injection device for fuel-injected internal combustion engines, in particular to a unit fuel injector, in which the control of the onset and end of supply is effected by means of a magnet valve (2) incorporated between a low-pressure circuit and a work chamber (10; 19) of a pump piston (1; 20), wherein a scavenging bore (6; 22), connectable to the work chamber (10; 19), of a scavenging line (7) that communicates with a low-pressure chamber or the fuel tank is provided, and wherein a delivery line (3; 18) for delivering the fuel from the magnet valve (2) to the work chamber (10; 19) of the pump piston (17; 20) discharges directly into the pump work chamber (10; 19) and communicates with the pump work chamber in a permanently open fashion, the mouth of the scavenging bore (6; 22) is located in a region of the guide bore (4; 23) of the pump piston (1; 11; 14; 20) which is overridden by the pump piston in all positions of the pump piston (1; 11' 14; 20), and this mouth is connectable at least indirectly to the delivery line (3; 17; 18) and the work chambers (10; 19) of the pump piston (1; 11; 14; 20) via a recess (8; 21) of the piston, in the region of the top dead center position of the piston (1; 11; 14; 20).

2. A fuel injection device as defined by claim 1, in that a delivery bore (3*a*) forming part of the delivery line (3) from the magnet valve (2) to the work chamber (10) discharges into the guide bore in a region of the top dead center position of the piston (1; 11) region of the guide bore (4) of the piston (1; 11) overridden by the recess (8), and a connecting bore (9) communicating openly with the work chamber (10) branches off from the guide bore (3*a*) near the mouth (5) thereof into the guide bore (4) of the piston (1; 11), wherein the recess of the piston is preferably embodied as an annular groove (8).

3. A fuel injection device as defined by claim 1, in that the recess or annular groove (8) of the pump piston (11; 14) communicates openly with the work chamber (10) thereof via a relief line (12, 12A) provided in the piston.

4. A fuel injection device as defined by claim 3, in that the relief line (12, 12A) in the pump piston (11; 14) has a longitudinal bore (12*a*), communicating openly with the work chamber (10) of the pump piston, and a transverse bore (13; 15) intersecting the longitudinal bore and discharging into the recess or annular groove (8).

5. A fuel injection device as defined by claim 4, in that a throttle cross section (16) is incorporated into one of the bores (15) of the relief line (12A) in the piston (14).

6. A fuel injection device as defined by claim 1, in that the delivery line (18) discharges only into the work chamber (19) of the pump piston (20), and an edge (25) toward the work chamber of the recess (21) of the pump piston (20) cooperates with a control edge (26*a*) of the guide bore (23) of the pump piston (20), wherein in the region of top dead center of the pump piston (20), the recess (21) connects the work chamber (19) of the pump piston (20) with the scavenging bore (22), optionally via an annular groove (24) into which the scavenging bore (22) discharges.

7. A fuel injection device as defined by claim 6, in that the recess is embodied by at least one transverse slit (21) in the jacket of the pump piston (20).

8. A fuel injection device as defined by claim 2, in that the recess or annular groove (8) of the pump piston (11; 14) communicates openly with the work chamber (10) thereof via a relief line (12, 12A) provided in the piston.

9. A fuel injection device as defined by claim 8, in that the relief line (12, 12A) in the pump piston (11; 14) has a longitudinal bore (12*a*), communicating openly with the work chamber (10) of the pump piston, and a transverse bore (13; 15) intersecting the longitudinal bore and discharging into the recess or annular groove (8).

10. A fuel injection device as defined by claim 9, in that a throttle cross section (16) is incorporated into one of the bores (15) of the relief line (12A) in the piston (14).

11. A fuel injection device as defined by claim 10, in that the delivery line (18) discharges only into the work chamber (19) of the pump piston (20), and an edge (25) toward the work chamber of the recess (21) of the pump piston (20) cooperates with a control edge (26*a*) of the guide bore (23) of the pump piston (20), wherein in the region of top dead center of the pump piston (20), the recess (21) connects the work chamber (19) of the pump piston (20) with the scavenging bore (22), optionally via an annular groove (24) into which the scavenging bore (22) discharges.

* * * * *